US007306251B2

(12) United States Patent
Bright et al.

(10) Patent No.: US 7,306,251 B2
(45) Date of Patent: Dec. 11, 2007

(54) RECLINING WHEELCHAIR

(75) Inventors: D. Anthony Bright, Cleveland, TN (US); Christeen Barr, Jasper, TN (US)

(73) Assignee: JLG, LLC, Jasper, TN (US)

( * ) Notice: Subject to any disclaimer, the term of this patent is extended or adjusted under 35 U.S.C. 154(b) by 142 days.

(21) Appl. No.: 11/062,204

(22) Filed: Feb. 18, 2005

(65) Prior Publication Data

US 2006/0113746 A1 Jun. 1, 2006

Related U.S. Application Data

(60) Provisional application No. 60/545,209, filed on Feb. 18, 2004.

(51) Int. Cl.
*A61G 7/00* (2006.01)

(52) U.S. Cl. ..... 280/304.1; 5/618

(58) Field of Classification Search ..... 280/250.1, 280/304.1, 304.5, 304.4, 755; 5/618
See application file for complete search history.

(56) References Cited

U.S. PATENT DOCUMENTS 2,682,913 A * 7/1954 Manternach ..... 297/87
3,495,869 A * 2/1970 Ingemansson ..... 297/71
4,691,962 A * 9/1987 Holdt ..... 297/84
4,795,214 A * 1/1989 Holdt ..... 297/440.2
4,997,200 A * 3/1991 Earls ..... 280/648
5,050,899 A * 9/1991 Stensby ..... 280/250.1
5,333,887 A * 8/1994 Luther ..... 280/250.1
5,865,457 A * 2/1999 Knabusch et al. ..... 280/304.1
6,715,784 B2 * 4/2004 Koerlin et al. ..... 280/650
6,792,622 B2 * 9/2004 Graves ..... 2/114
6,793,232 B1 * 9/2004 Wing ..... 280/304.1
6,799,770 B2 * 10/2004 Patrick et al. ..... 280/250.1
2005/0087968 A1 * 4/2005 Bennett et al. ..... 280/755

* cited by examiner

*Primary Examiner*—Tony Winner
(74) *Attorney, Agent, or Firm*—Louis Ventre, Jr.

(57) ABSTRACT

A wheelchair has a reclined configuration and an upright configuration. In the upright configuration, the seat of the wheelchair is at least substantially perpendicular to a back support and located at a first elevation. An actuator is useful to lift the seat during the movement to the reclined configuration to a second elevation higher than the first elevation. Outriggers move to load bearing position in the reclined configuration to assist in supporting weight on the back support. An installed litter is useful in assisting patient movement to and from the wheelchair.

5 Claims, 3 Drawing Sheets

RECLINING WHEELCHAIR

CLAIM OF PRIORITY

This application claims the benefit of U.S. Provisional Patent Application No. 60/545,209 filed Feb. 18, 2004.

FIELD OF THE INVENTION

The present invention relates to wheelchairs and more particularly to a reclining wheelchair which facilitates transfer of a patient from the wheelchair to a bed or for otherwise providing increased comfort to a patient in a wheelchair.

DESCRIPTION OF RELATED ART

Numerous efforts have been directed toward providing reclining wheelchairs such as U.S. Pat. No. 6,799,770 which shows a wheelchair configured to cooperate with a bed. This wheelchair locks to the bed during patient transfer from the wheelchair to the bed. This wheelchair provides a reclining back, but does not have a traditional self-operable set of wheels so that an individual with the use of their hands could propel themselves.

U.S. Pat. No. 6,715,784 shows a much more user friendly wheelchair which operates by motor-driven wheels. The disclosure appears to focus more on a reclining aspect of the back but does not appear to provide an ability to easily transfer a patient from this wheelchair to a bed.

Accordingly, even though similar efforts have been made to provide a patient friendly reclining back wheelchair, improvements are still believed to be desirable.

SUMMARY OF THE INVENTION

A need exists for a wheelchair capable of reclining for either patient comfort and/or either to transfer a patient from a wheelchair to a hospital bed.

Another need exists for a reclining wheelchair which provides the seat of a patient at a higher elevation when the patient is reclined than when sitting.

Another need exists for a reclining wheelchair which resists tipping over when in the reclining position.

Accordingly, a wheelchair according to the presently preferred embodiment of the present invention provides a seat operably coupled to a frame and a back support operably coupled to the seat. An actuator is useful to transition the wheelchair from an upright configuration wherein the back support is at least substantially perpendicular to the seat to a reclined position in which the seat and back support are at least substantially parallel.

In the preferred embodiment, during the transition from the upright configuration to the recline configuration the seat is elevated from a lower sitting position to a higher position so that the transfer to the hospital bed may be easier. Additionally, in the reclined position, outriggers are useful to stabilize the back support relative to a surface that the wheels of the wheelchair are transported over. Finally, a litter is useful when used in combination with the wheelchair. The litter is at least flexible if not hinged at key locations such as where the back support and the seat meet as well as where the seat support and the leg support meet so that the litter is unobstructed when utilized in conjunction with the wheelchair. When the wheelchair is placed in the reclined position, the litter can then be detached from the wheelchair and be utilized to transfer a patient to a hospital bed.

DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
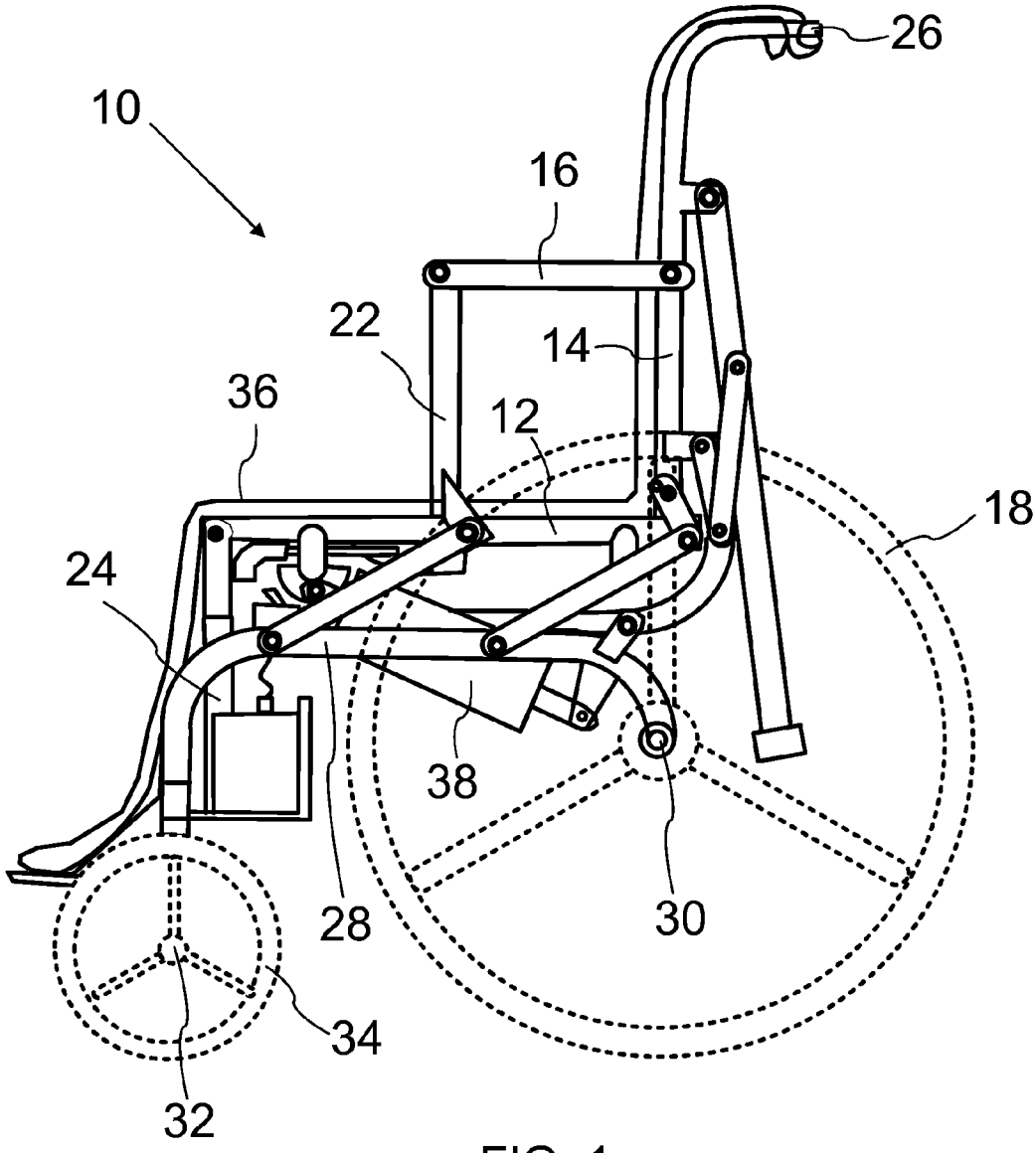
FIG. 1 is a side plan view with the wheels shown in phantom of a wheelchair constructed in accordance with the presently preferred embodiment of the present invention in an upright configuration.

FIG. 1 shows a side plan view of a wheelchair 10 of the presently preferred embodiment of the present invention. The wheelchair 10 provides a seat 12 and a back support 14. Arm rests 16 as shown in an in use position in FIG. 1 which allows a user to rest his or her arms thereupon. Large wheels 18 are disposed on left and right sides of seat 12 to allow an individual sitting in the wheelchair 10 to grab the large wheels 18 to propel his or herself. Note that the top of the wheel 20 extends a distance above the seat 12 in the upright configuration.

The arm support 16 is illustrated hinged to the back support 14 and stanchion 22. Although only one side is illustrated, it will be obvious to one skilled in the art that another side could be similarly or dissimilarly constructed. Stanchion 22 is illustrated hinged to the arms support 16 as well as the seat 12. The back support 14 is rotatable relative to the seat 12 as will be described below. The seat 12 is connected at a pivot to leg support 24 which is shown in the extended position in FIG. 2 and in the unextended position in FIG. 1. The back support 14 is connected to grips 26. It will be understood to one skilled in the art that two grips 26 are normally utilized to allow another individual to push a patient sitting in the wheelchair 10 on the seat 12 in a normal operation.

The wheelchair 10 is preferably constructed so that the back support 14 is at least substantially perpendicular to the seat 12 in an upright configuration. The back support 14 is positionable relative to the seat 12 as will be explained in further detail below in reference to other drawings so that the seat 12 and the back support 14 can be made to be substantially parallel and even more preferably at least about collinear with one another. A plurality of reclined positions may also be obtained.

Another portion of the wheelchair 10 is the frame 28 which provides a connection for axle 30 which allows rotation of the large wheels 18 relative to the seat 12 and other components of the wheelchair 10 as well as a connection point for axle 32 for small wheels 34 so they can also be similarly rotated relative to the seat 12. Large and small wheels 18,34 are known in the art of wheelchairs.

Of course, large and small wheels 18,34 are utilized with manually operable wheelchairs 10 such as the embodiment as shown. Other wheelchairs may be electronically driven and/or may use other sized wheels or even more or fewer wheels than illustrated in the preferred embodiment. Litter 36 is illustrated atop the seat 12 and over the back support 14 and connected at the grip 26. The litter 36 also preferably extends down over at least a portion of the leg support 24.

Operation of the litter 36 will be described in further detail in reference to other drawings.

Figure 2:
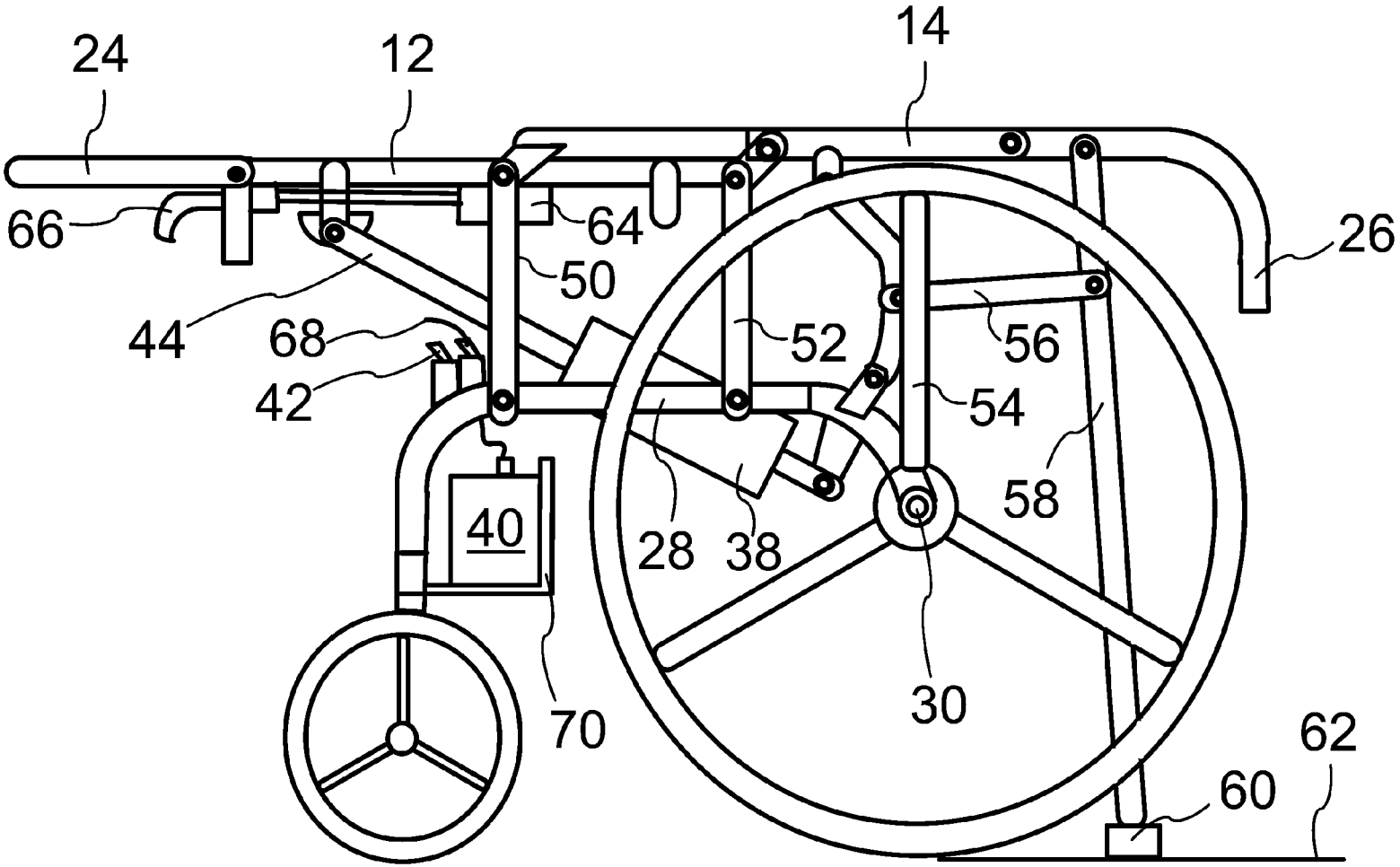
FIG. 2 is the wheelchair of FIG. 1 shown in a reclined configuration.

While transitioning the wheelchair 10 from the upright configuration shown in FIG. 1 to a reclined position as shown in FIG. 2, a number of mechanisms are useful. First, a linear actuator 38 which may be driven from an electric power supply such as battery 40 operated by first switch 42 has been found useful. The linear actuator 38 extends from a contracted position shown in FIG. 1 to the extended position shown in FIG. 2 with push rod 44 extending a greater distance from cylinder 46 in FIG. 2 than shown in FIG. 1. It is also possible to hae intermediate positions between the reclined and upright configurations. Other actuator mechanisms as is known in the art could also be utilized such as electric motors, hydraulic pumps, chain drive, etc. . . .

The seat 12 is connected to the frame 28 by legs 50,52. The top of the legs 50,52 is illustrated connected to the seat 12. The bottom of the legs 50,52 is shown connected to the frame 28. Upon extension of the rod 44 from the cylinder 46 by the activation of switch 42 driving the linear actuator 38 or other appropriate mechanism, the legs 50,52 rotate as illustrated from FIG. 1 to FIG. 2 thereby elevating the seat 12 relative to the top 20 of the wheel 18. As shown in FIG. 2, the seat 12 is now a distance above the top 20 of the big wheel 18 in the reclined position. This prevents the wheel 18 from interfering with the transfer of a patient to a bed.

Meanwhile, while the seat 12 is being elevated, the arm 54 connected to the frame 28 is hingedly connected to the back support 14. Accordingly, as the seat 12 rotates upwardly, the back support 14 rotates to the position shown in FIG. 2 so that it is now substantially parallel to if not coplanar with the seat 12. Furthermore, link 56 pushes outrigger in the form of a post 58 into position so that foot 60 contacts the ground 62 when in the prone position so that weight located on the back support 14 towards the grips 26 can be assisted in support by the post 58 to prevent rotation about the axle 30. Basically this ensures the wheelchair 10 doesn't flip over when loaded. The arm rests 16 also rotate preferably out of the way. When going from reclined to upright, the outrigger is lifted by back support 14 off of the ground 62 and rotated by link 56 towards the back support 14 out of the way.

The outrigger(s) could be provided as a single support in some embodiments. Furthermore, instead of being hingedly brought into a supporting position on the ground and retracted position when the wheelchair is in an upright configuration with a linking mechanism, other mechanisms could also be utilized to transition the outrigger(s) into position. Hydraulic pumps, linear actuators, chain driven devices, etc. as known in the art could at least assist in the transition.

While these features are enough to make a person prone from their knees up, it has been helpful to extend the legs of a person below the knees to complete the prone positioning of a patient on the wheelchair 10. Leg support 24 can be extended as shown in FIG. 2 by the operation of a driver 64 which pushes extension 66 outwardly to lift the leg support 24 as shown in FIG. 2. In FIG. 1, the leg extension 66 is in a retracted position allowing the leg support 24 to rotate so that it would not be supporting the weight of the lower legs of the person.

A second switch 68 is useful to control the driver 64. In some embodiments, the ability to make the legs support 24 copoint substantially planar with the seat 12 parallel to the seat 12 in back support 14 may be done by a single switch in a single coordinated motion or through multiple switches and movements. Battery case 70 is useful to store battery 40 to drive the linear actuator 38 and/or driver 64. Furthermore, the battery 40 may be utilized to drive motorized wheelchairs in other embodiments. More than battery 40 may be utilized.

Figure 3:
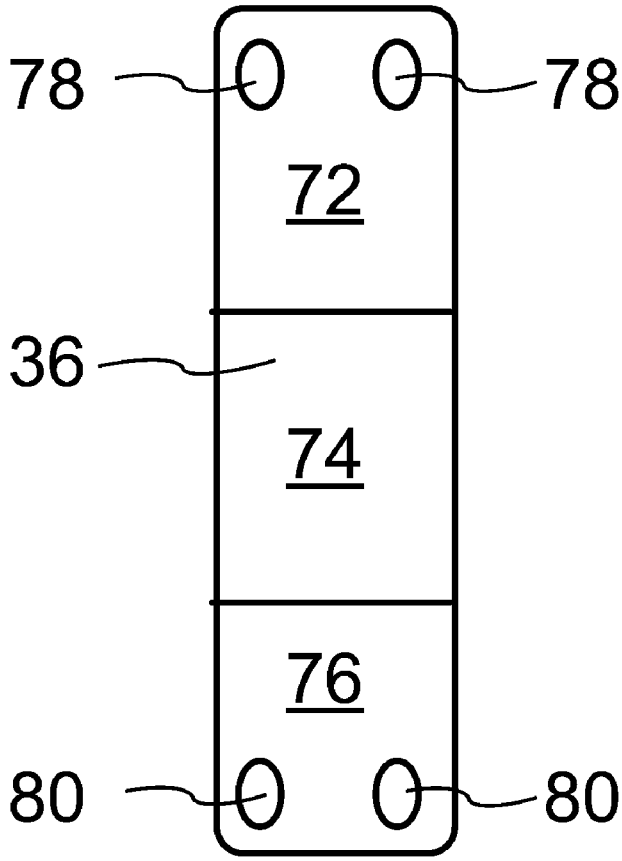
FIG. 3 is a top plan view of the litter shown in FIG. 1 removed from the wheelchair.

The litter 36 as shown in FIG. 1 is shown removed in FIG. 2 and from a top view in FIG. 3. The litter 36 is hinged or at least flexible at the intersections of a first section 72, second section 74 and third section 76. First section 72 cooperates with a head and a back of an individual. A second section 74 may be located below the seat of an individual. Lower section 76 may be utilized at least partially under the legs of an individual. By providing a hinged or flexible litter 36, the litter 36 can be stored connected in position as shown in FIG. 1 on the wheelchair 10. The litter 36 may be constructed of similar or dissimilar material as materials utilized with the remainder of the wheelchair 10. High strength polyethylene, urethane and/or reinforced fabric is a possibility for the litter 36 as well as for portions of the seat 12, etc.

Figure 4:
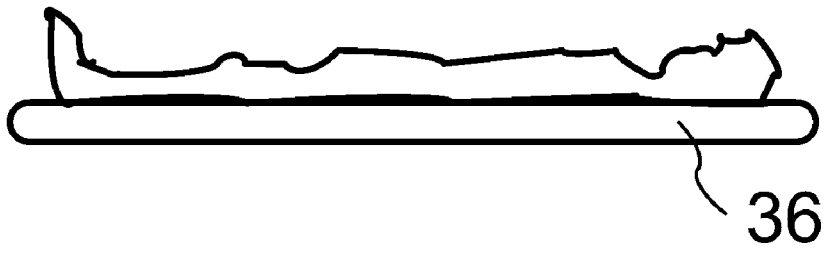
FIG. 4 shows the litter shown in FIG. 1 in operation.

When the wheelchair 10 is extended in the reclined configuration shown in FIG. 2, the litter 36 may be prone as shown in FIG. 4. One or more individuals can utilize the litter 36 to assist in moving a patient from the wheelchair 10 to a bed such as a hospital bed or other desired location. Handholds 78,80 are useful at either end of the litter 36 as shown in FIG. 3 for either moving the head or the legs of an individual on the litter 36 either one at a time or together.

In order to return the wheelchair 10 from its reclined position shown in FIG. 2 to its upright position shown in FIG. 1, the switch 42 or switches 42,68 may be operated in the opposite direction to retract the leg extension 66 and/or to withdraw the rod 44 relative to the cylinder 46 to allow the seat 12 to lower back into its position which, in the preferred embodiment, is assisted by gravity. Furthermore, while the seat 12 is lowering to its position relative to the frame 28, the back support 14 is rotated back into the upright position as shown in FIG. 1. The arm rests 16 rotate back into position and the outrigger is moved to the position shown in FIG. 2. One skilled in the art will understand that with telescoping members for the back support 14 or otherwise, the back support 14 may be adjustable for a user's height.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed:

1. A wheelchair comprising: a seat operably connected to a frame; a back support operably coupled to the seat; at least one wheel connected to the frame allowing movement of the wheelchair, wherein the at least one wheel comprises a rear wheel, said rear wheel having a topmost surface, and the topmost surface of the rear wheel extending a distance above the seat at the first elevation, and seat extending a distance above the topmost surface of the rear wheel at the second elevation; an actuator coupled to the seat; wherein the wheelchair has an upright configuration wherein the seat is located at a first elevation and the back support is substantially perpendicular to the seat; and the wheelchair has a reclined configuration wherein the back support is substantially parallel to the seat, and the seat is lifted to a second elevation with the actuator, said second elevation being higher than the first elevation.

2. A wheelchair comprising: a seat operably connected to a frame; a back support operably coupled to the seat; at least one wheel connected to the frame allowing movement of the wheelchair; an actuator coupled to the seat; wherein the wheelchair has an upright configuration wherein the seat is located at a first elevation and the back support is substantially perpendicular to the seat; the wheelchair has a reclined configuration wherein the back support is substantially parallel to the seat, and the seat is lifted to a second elevation with the actuator, said second elevation being higher than the first elevation; and a litter having a first section and a second section connected at a hinge, said hinge positioned proximate to a rear portion of the seat and a lower portion of the back support, said litter connected to the wheelchair in an installed configuration.

3. A wheelchair comprising: a seat operably connected to a frame; a back support operably coupled to the seat; at least one wheel connected to the frame allowing movement of the wheelchair; and a litter having a first section and a second section connected at a hinge, said hinge positioned proximate to a rear portion of the seat and a lower portion of the back support, said litter connected to the wheelchair in an installed configuration; wherein the wheelchair has a reclined configuration wherein the back support is substantially parallel to the seat; and wherein the wheelchair has an upright configuration wherein the back support is at least substantially perpendicular to the seat.

4. The wheelchair of claim 3 further comprising at least one outrigger operably coupled to the back support; wherein when the wheelchair is in the reclined configuration the outriggers are in contacting engagement with a surface supporting the at least one wheel and the back support; and wherein the wheelchair is in the upright configuration outrigger is moved out of contacting engagement with at least one of the surface and the back support.

5. The wheelchair of claim 3 wherein when wheelchair is in the upright configuration-the seat is located at a first elevation; and when the wheelchair is in the reclined configuration wherein the seat is at a second elevation, said second elevation is higher than the first elevation.

* * * * *